US007959516B2

(12) United States Patent
Hansen

(10) Patent No.: US 7,959,516 B2
(45) Date of Patent: Jun. 14, 2011

(54) FERRULE AND HOLE CUP FOR GOLF FLAG

(76) Inventor: Finn Skade Hansen, Viborg (DK)

( * ) Notice: Subject to any disclaimer, the term of this patent is extended or adjusted under 35 U.S.C. 154(b) by 0 days.

(21) Appl. No.: 12/313,873

(22) Filed: Nov. 25, 2008

(65) Prior Publication Data

US 2009/0137331 A1 May 28, 2009

(30) Foreign Application Priority Data

Nov. 28, 2007 (DK) ..... 2007 01693

(51) Int. Cl.
*A63B 57/00* (2006.01)

(52) U.S. Cl. ..... 473/176

(58) Field of Classification Search ..... 473/175–179
See application file for complete search history.

(56) References Cited

U.S. PATENT DOCUMENTS 3,348,797 A 10/1967 Turbyfill
4,114,879 A 9/1978 Oiler
4,905,624 A * 3/1990 Krolzick ..... 116/173
2002/0039538 A1* 4/2002 Yamada et al. ..... 417/572
2002/0198059 A1* 12/2002 Gilmour ..... 473/176
2003/0096659 A1* 5/2003 Webb ..... 473/174
2008/0171609 A1* 7/2008 Priegel ..... 473/176

FOREIGN PATENT DOCUMENTS

GB 2 382 311 5/2003

* cited by examiner

*Primary Examiner* — Mark S Graham
(74) *Attorney, Agent, or Firm* — James Creighton Wray

(57) ABSTRACT

A ferrule (1) and a hole cup (2) for a golf flag (3), where the ferrule (1) is designed with a boring (4) in which a golf flag (3) is placed, and an upper part (5) having a greater diameter than a lower part (6) of the ferrule which is intended for disposition in a hole (7) in the hole cup (2), the hole cup (2) being formed by a cylindric wall (8) and a bottom (9) with a centre hole (7) having a shape and a depth for receiving the lower part (6) of the ferrule, where at least two replaceable elastic means (10) are provided between the lower part (6) of the ferrule and the centre hole (7) of the hole cup, where at least two fastening means (11) are correspondingly provided, each intended for retaining an elastic means (10), and each provided by an annular groove (15) on the ferrule (1), and where one or more longitudinal grooves (16) are provided in the ferrule (1).

20 Claims, 5 Drawing Sheets

FERRULE AND HOLE CUP FOR GOLF FLAG

This application claims the benefit of Danish Application No. PA 2007 01693 filed Nov. 28, 2007, which is hereby incorporated by reference in its entirety.

FIELD OF THE INVENTION

The present invention concerns a ferrule and a hole cup for a golf flag, where the ferrule is designed with a boring in which a golf flag is placed, and an upper part having a greater diameter than a lower part of the ferrule which is intended for disposition in a hole in the hole cup, the hole cup being formed by a cylindric wall and a bottom with a centre hole having a shape and a depth for receiving the lower part of the ferrule.

BACKGROUND OF THE INVENTION

On golf courses, a golf flag is placed in hole cups located in a green or a practice area about 2-3 cm under the grass surface. The hole cups are about 15 cm deep, and are provided in the bottom with a boring that fits a ferrule which is mounted at the bottom of the flag stick. It is necessary that the ferrule fits tightly in the hole cup in order for the flag to stand upright. There are two reasons for which it is particularly important for the flag to stand straight up. When the ball is shot towards a hole from a certain distance, the golf player uses the flag as sighting point, and if the flag stick does not stand straight in the hole cup, the golf player will have difficulty in sighting correctly. The other reason is that when the flag stick stands skew, it may block the hole for the golf ball when shooting towards hole outside the green where the flag stands in the hole cup.

The golf flag is subjected to wind action, giving rise to two effects which reduce the durability of the ferrule and the hole cup—friction by rotation and mechanical loads between ferrule and hole cup, respectively. Wind from different directions will make the ferrule rotate in the hole cup if the friction between the two elements is not sufficient to prevent such rotation. The friction forces will wear the ferrule and the hole cup such that a play arises. The golf flag may now tilt, giving rise to additional wear. Another effect of the mentioned rotation of the ferrule in the hole cup is that the ferrule will slowly be rotated up of the hole cup. When the engagement of the ferrule in the hole cup becomes insufficient, the flag will turn over completely. Therefore, manual check of all flags on a golf course has to be performed before each day of playing in order to ensure that all flags are standing in their hole cup.

To this is added influence from common use which consists of taking the flag up and putting it down in the hole cup each time a player reaches the green. The ferrule and the centre hole in the hole cup will thus be gradually worn, whereby the fit between the two elements becomes more and more loose. The golf flag may thereby be tilted with deflections that are gradually increased, which by itself will accelerate the wear. The position of the hole cup under the ground surface will furthermore entail that sand and soil may come into the hole cup and its centre hole, further accelerating the above process. At some point, the size of the mentioned deflections occurring when the golf flag tilts will be unacceptable, and the golf flag has to be replaced.

U.S. Pat. No. 4,114,879 discloses a solution where the lowermost part of the ferrule is a cylinder provided with two collars. According to the disclosure, these collars have an anchoring effect against the wind action such that the flag retains its upright position. The disadvantage of this embodiment is that the collars will be worn rapidly as the wearing faces are becoming smaller. Moreover, there is a clearance between the ferrule and the hole cup opposite the lower collar, as this collar has smaller diameter, why sand grains may appear between the collar and the hole cup, contributing to additional wear. The ferrule will thus rapidly loose its straightening effect.

OBJECT OF THE INVENTION

It is the object of the invention to provide a ferrule and a hole cup with greater resistance against wear and thereby longer durability. At the same time, the ferrule and the hole cup are to maintain the ability to keep the flag upright, even after being subjected to wind and weather for a long time and to usual wear during use, including rotation of the ferrule in the hole cup. In addition, the ferrule and the hole cup are to bring the flag back into upright position immediately after a wind gust having moved the flag.

DESCRIPTION OF THE INVENTION

According to the present invention, this is achieved by a ferrule and a hole cup of the type specified in the introduction which are peculiar in that at least two replaceable elastic means are provided between the lower part of the ferrule and the centre hole of the hole cup, and that correspondingly at least two fastening means are provided, each intended for retaining an elastic means, and each provided by an annular groove on the ferrule, and that one or more longitudinal grooves are provided in the ferrule.

The elastic means increase the friction between the ferrule and the hole cup such that the golf flag does not rotate in the hole cup. Wear caused by the ferrule rubbing against the wall of the centre hole as well as the ferrule turning itself up of the hole cup, causing overturning of the flag, are thereby avoided.

Furthermore, elastic materials are less susceptible to wear from sand and soil as they are resilient. Besides, the elastic means will provide a spacing between the ferrule and the hole cup such that sand and soil do not get caught in the interspace. The lower elastic means will function as a scraper that cleans the centre hole of the hole cup of impurities such as sand and soil.

The material for the elastic means is chosen such that it is resilient, however with rapid contraction such that it rapidly returns to its initial position. This may be rubber or other elastic material. Thereby, the flag will rapidly rise up again after a wind action. Practical experiments with the indicated solution has surprisingly shown that the ferrule and the hole cup retain the ability of keeping the golf flag straight during the whole service life, and the service life of the golf flag is now limited by the durability of flag stick and golf flag.

In a preferred embodiment, the two elastic means are provided between the lower part of the ferrule and the centre hole of the hole cup, and two fastening means for retaining the elastic means are optionally provided in the ferrule or the hole cup.

It is important that the distance between the fastening means is as large as possible, as it increases the stability of the golf flag.

The annular groove enables application of a standard O-ring. Since the fastening means and the elastic means do not constitute a permanent assembly in this embodiment, it is possible to replace the elastic means. The service life of the ferrule or the hole cup is increased significantly thereby.

The purpose of the longitudinal grooves is to facilitate replacement of the elastic means as there is provided the possibility of manipulating the elastic means with a suitable tool so that it may easily be removed from the annular groove.

According to a further embodiment, the ferrule and the hole cup according to the invention are peculiar in that an elastic means is annular and optionally provided with a polygonal or round cross-section, such as an O-ring. The elastic means may advantageously be selected among commercially available standard components. Availability and price can be a main factor for this choice.

According to an alternative embodiment, the ferrule and the hole cup according to the invention are peculiar in that a fastening means is a glue joint optionally provided on the ferrule or the hole cup, respectively. If the elastic means is chosen such that it is provided on the surface of the lower part of the ferrule or the wall of the centre hole of the hole cup, it is required to add a glue joint in order to retain the elastic means.

According to a further embodiment, the ferrule and the hole cup according to the invention are peculiar in that the lower part of the ferrule has cylindric shape.

Hereby it is ensured that the ferrule does not get wedged into the centre hole of the hole cup. The flag may thus be taken up of the hole in a sure and rapid way, which is a great advantage at the approach to the hole where the flag is removed after playing the ball and immediately before the ball rolls into the hole.

According to a further embodiment, the ferrule and the hole cup according to the invention are peculiar in that the at least two elastic means are disposed at the two ends of the lower part of the ferrule, and that each additional elastic means is disposed between the at least two elastic means.

By disposing the elastic means at each end of the lower part of the ferrule is achieved that they are positioned as far away from each other as possible. Maximum stability and certainty against overturning of the flag are thereby achieved. One elastic means is disposed at a distance from the upper part of the ferrule such that the elastic means is ensured engagement in the centre hole of the hole cup, and the other elastic means is disposed spaced apart from the lowermost end of the ferrule as seen during use, such that the elastic means is ensured engagement with the centre hole of the hole cup.

In embodiments where there are three or more elastic means, the further elastic means will be distributed between the two first elastic means which are provided at each their end of the lower part of the ferrule.

According to a further embodiment, the ferrule and the hole cup according to the invention are peculiar in that the lower part of the ferrule is provided a length which is greater than the depth of the centre hole of the hole cup.

Hereby is achieved that the lower part of the ferrule extends through and to a position outside the centre hole of the hole cup. When the flag is placed in the hole cup, the ferrule will clean the centre hole of the hole cup from soil, sand and dirt which are entirely removed from the hole cup.

According to a further embodiment, the ferrule and the hole cup according to the invention are peculiar in that a fastening means is designed to accommodate a 4 mm O-ring. Surprisingly, it has appeared that it is advantageous to design the fastening means so that it may accommodate a 4 mm O-ring, after which a 3 mm O-ring is placed at first which is replaced by a 3.5 mm O-ring later, and eventually a 4 mm O-ring, as the ferrule and the hole cup, respectively, are worn.

In a particular embodiment, the lower part of the ferrule has diameter of 27.3 mm and a length of 50.5 mm. It is designed with two annular grooves that have a polygonal cross-section with a width of 3.6 mm and a depth of 3.05 mm. The annular grooves are provided 9 mm and 41 mm, respectively, from the lowermost end of the ferrule as viewed during use. The ferrule is provided with a longitudinal groove with a partly circular cross-section with a radius of 4 mm and a centre of the part circle of 14.75 mm from a centre axis through the ferrule.

The ferrule and the hole cup can be made of aluminium, steel or a plastic material.

The ferrule and the hole cup according to the invention may be used separately. Hole cups have standard sizes that enable implementation of the invention on the ferrule and the hole cup, respectively, without influencing the other part. A ferrule according to the invention may thereby be used with a standard and commercially available hole cup, and a hole cup according to the invention may be used with a standard and commercially available ferrule.

DESCRIPTION OF THE DRAWING

The invention will now be explained more closely with reference to the accompanying drawing, where.

DETAILED DESCRIPTION OF THE INVENTION

Figure 1:
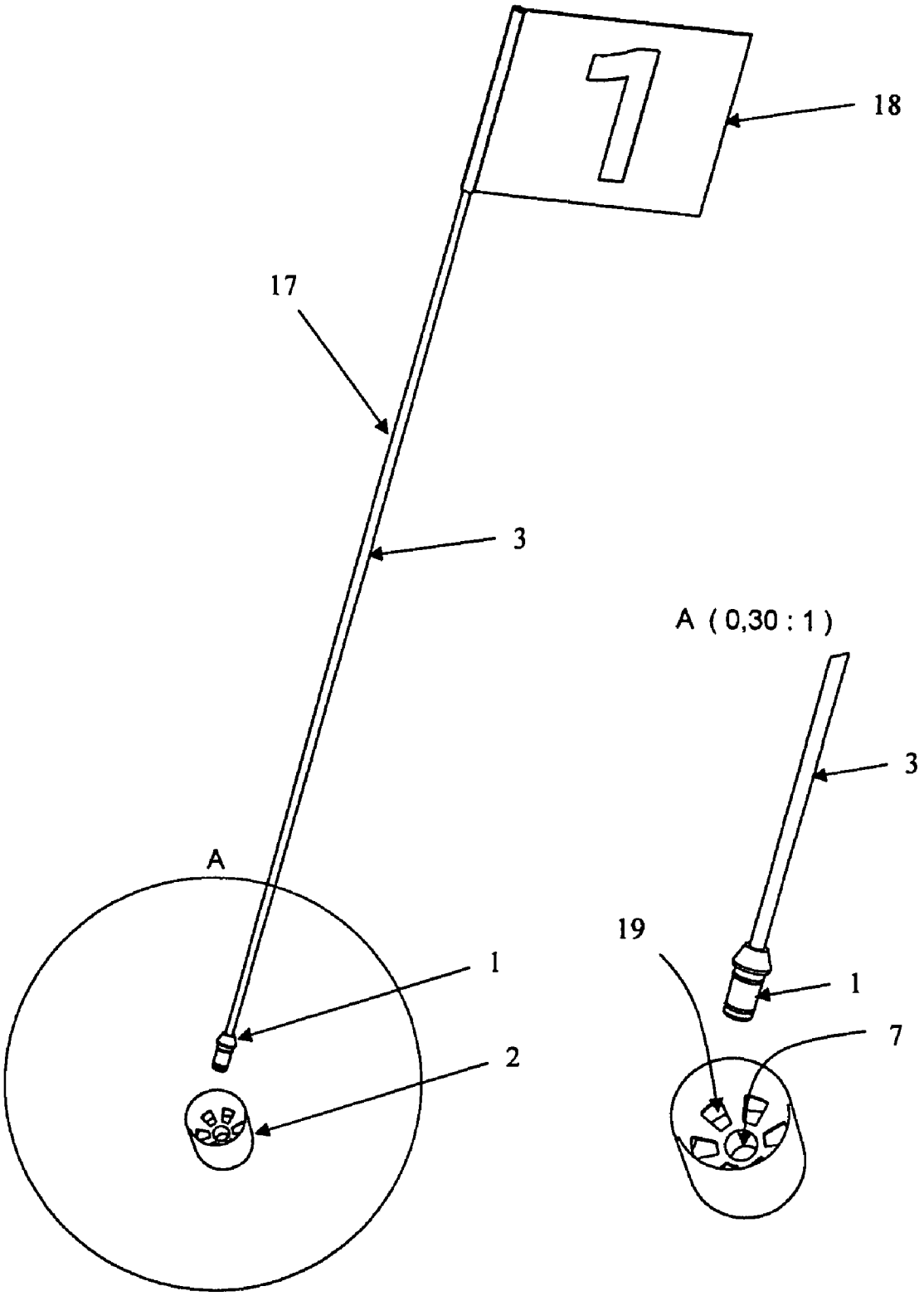
FIG. 1 shows a perspective view of a golf flag with ferrule and hole cup.

FIG. 1 shows a perspective view of a golf flag 3 with associated ferrule 1 and hole cup 2. The golf flag 3 consists of a flag stick 17 and a flag 18 which is disposed at the top of the flag stick 17. The ferrule 1 is mounted at the bottom of the flag stick 17, as the flag stick 17 is pressed down into the boring (not shown) of the ferrule. The hole cup 2 is made with a number of drain holes 19 such that the hole cup 2 is not filled with water in connection with precipitation. The flag 18 can be made of a nylon fabric and the flag stick 3 can be made of glass fibre composite or other suitable material.

Figure 2:
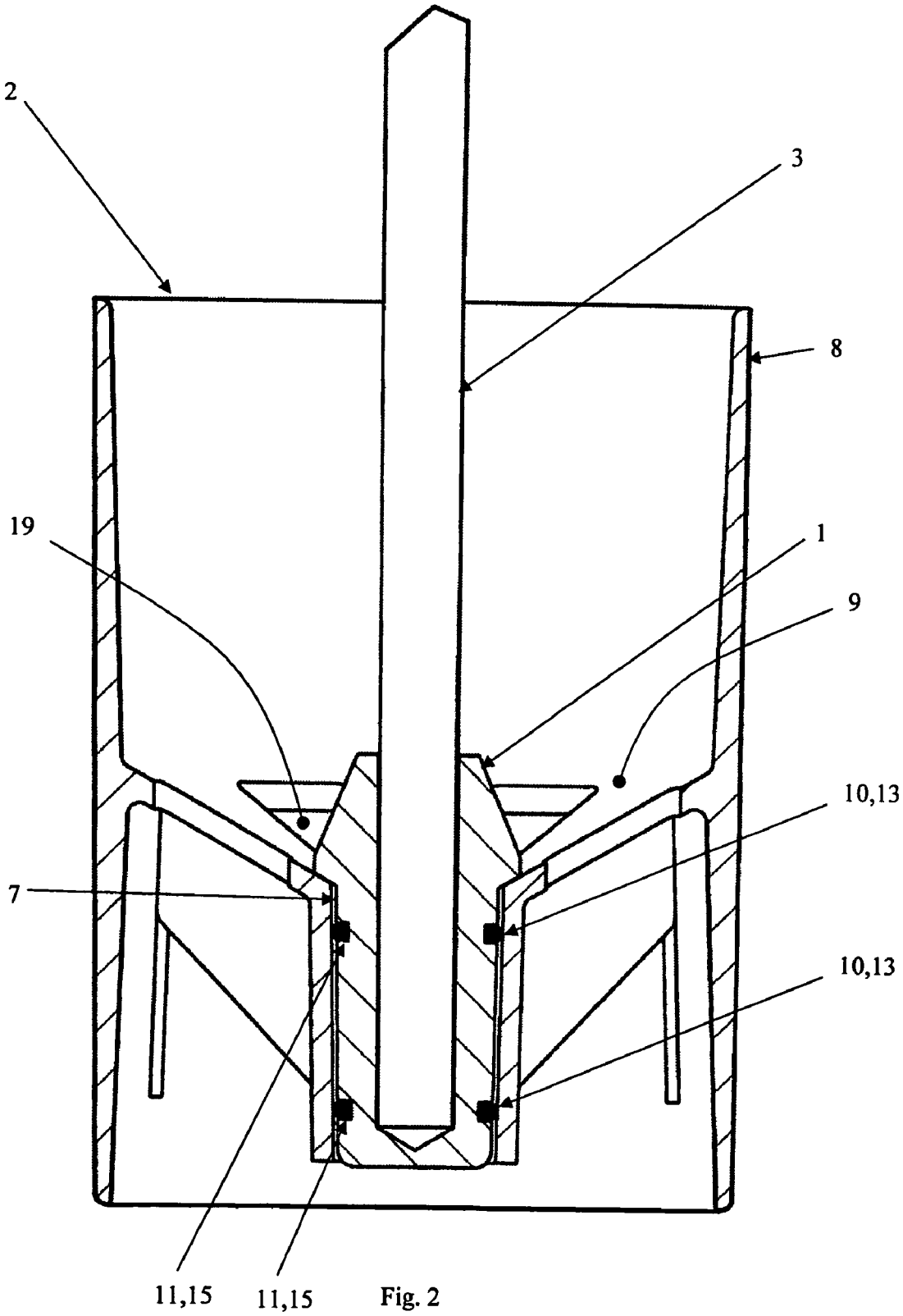
FIG. 2 shows a section of a ferrule with elastic means inserted in a hole cup.

FIG. 2 shows a sectional view of the ferrule 1 and the hole cup 2. The ferrule 1 is provided in the centre hole 7 of the hole cup. Moreover, the hole cup 2 is constituted by a wall 8 and a bottom 9. The ferrule 1 and the hole cup 2 are shown in an embodiment where two elastic means 10 are provided on the ferrule 1. The fastening means 11 are provided as two annular grooves 15 in the ferrule 1. In the shown embodiment, the elastic means 10 have a round cross-section 13 and are provided as O-rings.

Figure 3:
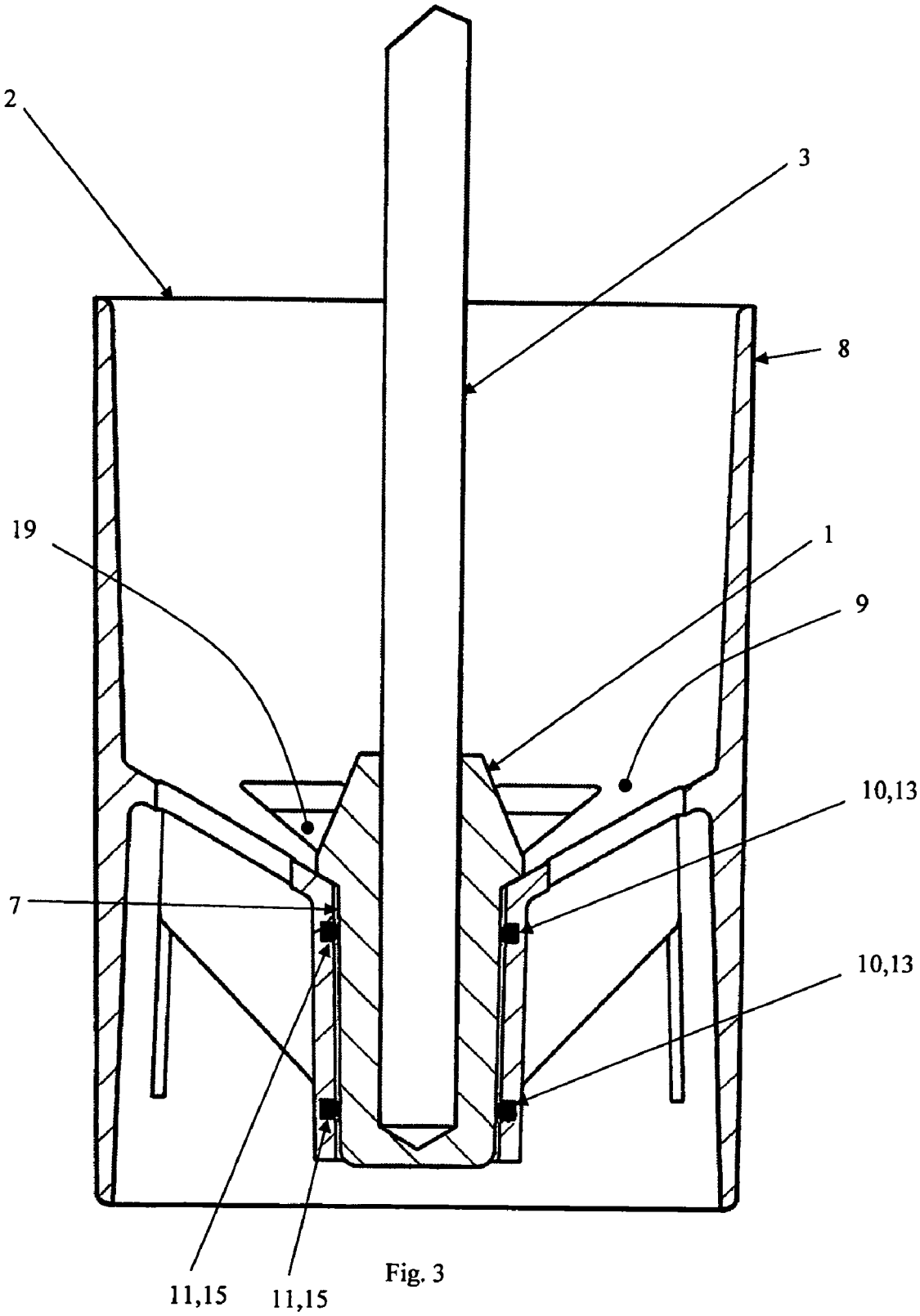
FIG. 3 shows a section of a ferrule inserted in a hole cup with elastic means.

FIG. 3 shows a sectional view of the ferrule 1 and the hole cup 2. The ferrule 1 is provided in the centre hole 7 of the hole cup. Moreover, the hole cup 2 is constituted by a wall 8 and a bottom 9. The ferrule 1 and the hole cup 2 are shown in an alternative embodiment where two elastic means 10 are provided in the hole cup 2. The fastening means 11 are provided as two annular grooves 15 in the hole cup 2. In the shown embodiment, the elastic means 10 have a round cross-section 13 and are provided as O-rings.

Figure 4:
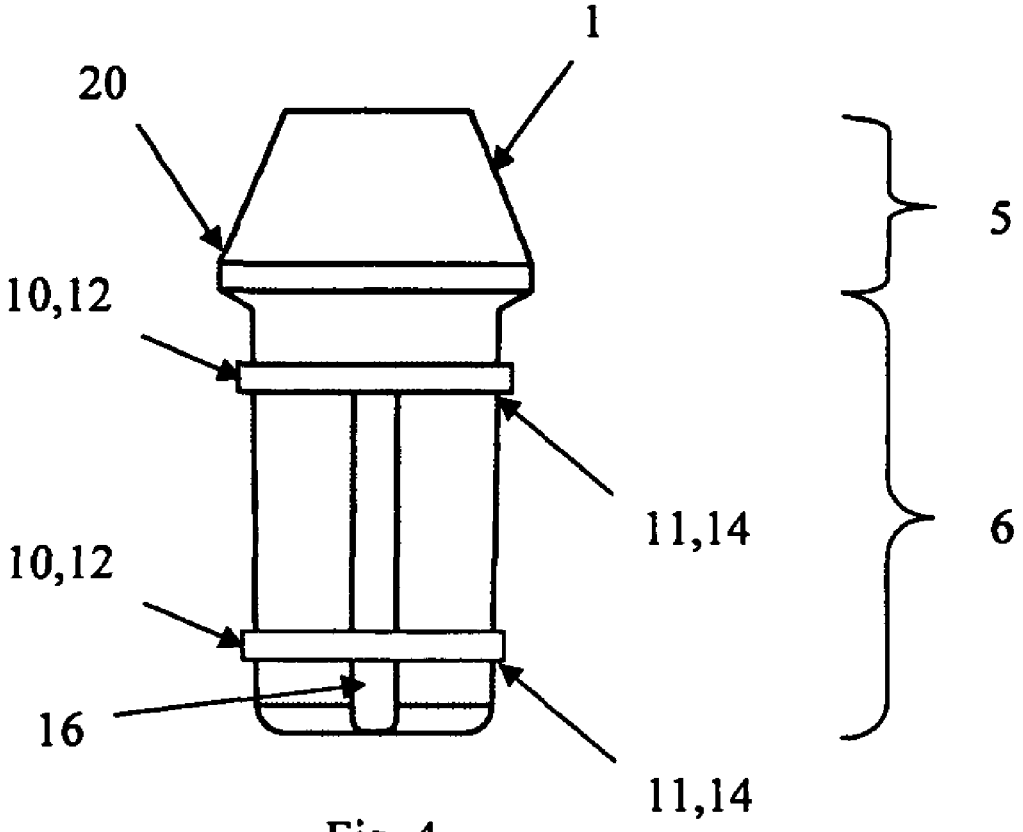
FIG. 4 shows a side view of a ferrule.

FIG. 4 shows a side view of the ferrule 1. The upper part 5 of the ferrule has greater diameter than the lower part 6. In the shown embodiment, the upper part is constituted by a collar 20 that limits the depth of the ferrule in the centre hole (not shown) of the hole cup. In the shown embodiment, the ferrule 1 is shown with two elastic means 10 of a type with polygonal cross-section 12, where the fastening means 11 is constituted by a glue joint 14 between the ferrule 1 and the elastic means 10. The ferrule 1 is provided with a longitudinal groove 16 which has a dimension such that it is possible to manipulate the elastic means 10 with a tool in connection with dismounting and replacement of the elastic means 10. The tool may be a screwdriver or another simple and cheap tool that is available.

Figure 5:
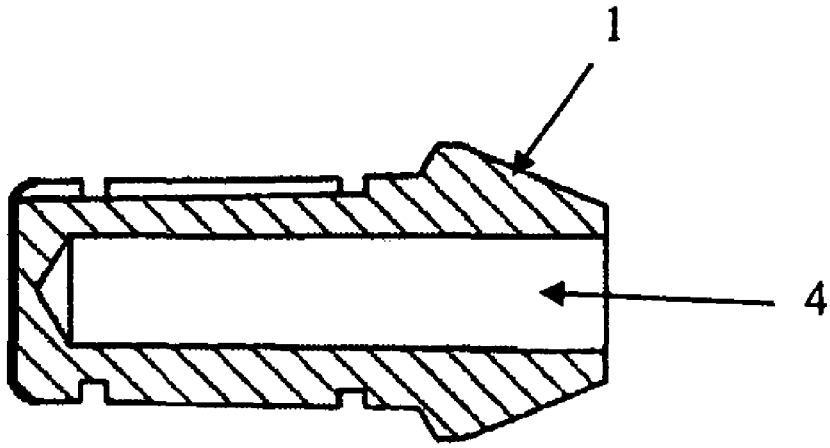
FIG. 5 shows a sectional view of a ferrule.

FIG. 5 shows a section through the ferrule 1. A boring 4 in the ferrule is intended for receiving the flag stick (not shown).

The material of the O-ring is an ozone-resistant and UV-resistant rubber material known from the food industry. The material may e.g. be ethylene propylene (EPDM) with the designation EPDM 75 E7050PF FDA/USP 211 AS/BS FDA/USP/NSF marketed by the company M seals.

The O-ring has a typical diameter of 3 to 5 mm, preferably 3.53 mm with a diameter of 20.22 mm. The annular groove is designed such that the O-ring has a typical extension across the surface of the ferrule of 4-5 tenths of a millimeter or more.

Figure 6:
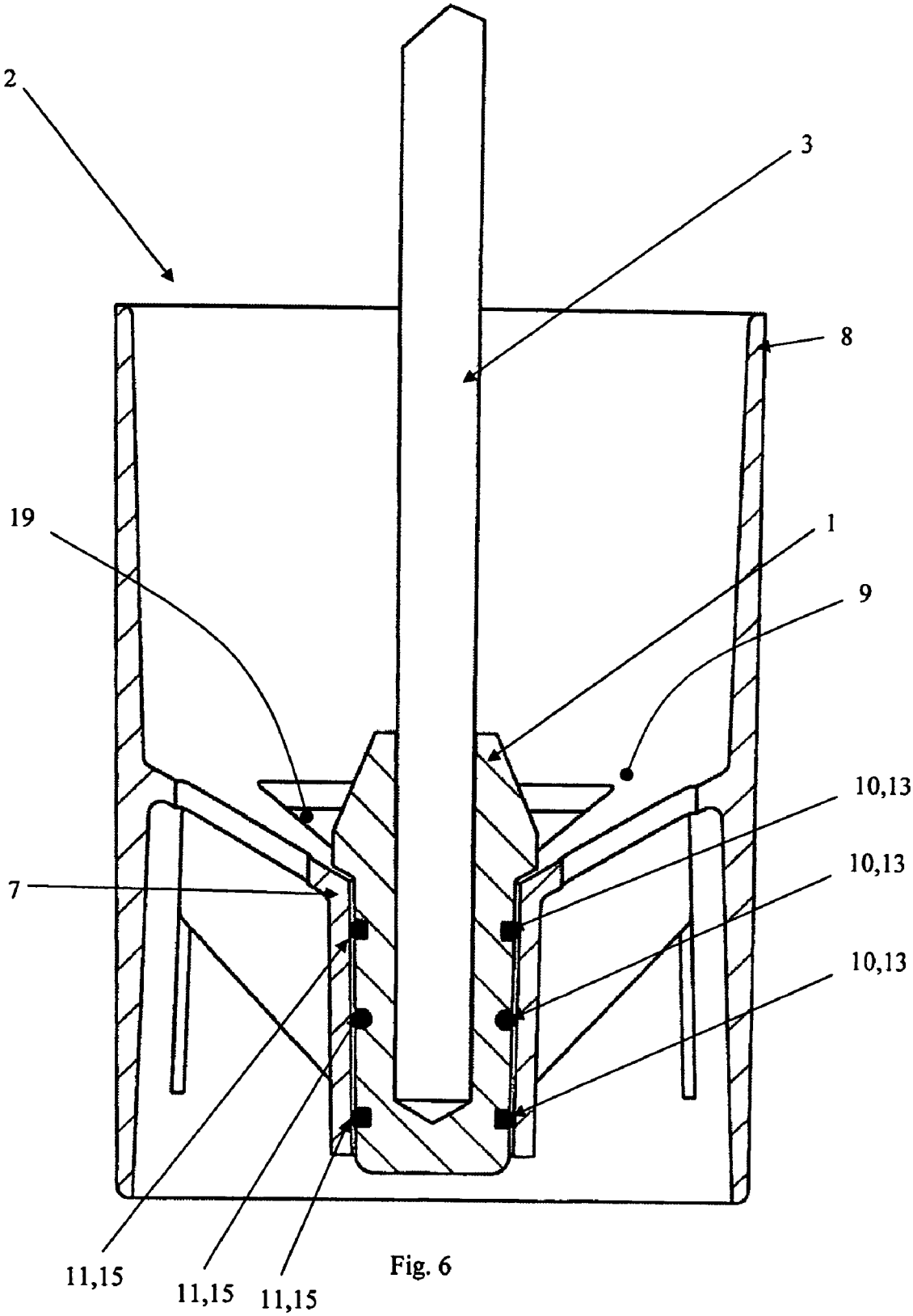
FIG. 6 shows a section of a ferrule with three elastic means inserted in a hole cup.

FIG. 6 shows a sectional view of the ferrule 1 and the hole cup 2. The ferrule 1 is provided in the centre hole 7 of the hole cup. Moreover, the hole cup 2 is constituted by a wall 8 and a bottom 9. The ferrule 1 and the hole cup 2 are shown in an embodiment where three elastic means 10 are provided on the ferrule 1. The fastening means 11 are provided as three annular grooves 15 in the ferrule 1. In the shown embodiment, the elastic means 10 have a round cross-section 13 and are provided as O-rings.

In the shown embodiment, the ferrule extends entirely through the centre hole of the hole cup.

The invention claimed is:

1. Apparatus comprising a ferrule (1) and a hole cup (2) for a golf flag (3), where the ferrule (1) has a boring (4) in which a bottom end of a flag stick (17) of the golf flag (3) is placed, and wherein the ferrule has a relatively short upper part (5) and a relatively long lower part (6), the upper part (5) having a greater diameter than the lower part (6) of the ferrule which is intended for disposition in a center hole (7) in the hole cup (2), the hole cup (2) being formed by a cylindric wall (8) and a bottom (9) with the center hole (7) having a shape and a depth for receiving the lower part (6) of the ferrule, wherein at least two replaceable elastic means (10) are provided far away from each other between each end of the lower part (6) of the ferrule and the center hole (7) of the hole cup, for maximum stability and certainty against overturning the flag and correspondingly at least two fastening means (11) are provided far away from each other in the lower part of the ferrule, each for retaining one of the elastic means (10), and each of the fastening means being provided by an annular groove (15) on the ferrule (1), and one or more longitudinal grooves (16) are provided in the ferrule (1) extending through the annular grooves for removing the elastic means before replacing the elastic means, and wherein the elastic means spaced far away from each other on the lower part of the ferrule and extending between the lower part of the ferrule and the center hole provide greater resistance against wear and longer durability and maintain an ability to keep the flag stick upright even after being subjected to wind and weather and usual wear during use.

2. Ferrule and hole cup according to claim 1, wherein the at least one elastic means (10) is annular and is optionally provided with a polygonal cross-section (12), such as a rubber band, or a round cross-section (13), such as an O-ring.

3. Ferrule and hole cup according to claim 1, wherein the lower part (6) of the ferrule has cylindric shape.

4. Ferrule and hole cup according to claim 1, wherein the at least two elastic means (10) are disposed at upper and lower two ends of the lower part of the ferrule, and that each additional elastic means (10) is disposed between the at least two elastic means (10).

5. Ferrule and hole cup according to claim 1, wherein the lower part (6) of the ferrule has a length which is larger than the depth of the centre hole (7) of the hole cup.

6. Ferrule and hole cup according to claim 1, wherein the elastic means are 4 mm O-rings, and the fastening means (11) are annular grooves (15) in the ferrule that receive a the 4 mm O-rings.

7. Use of the ferrule according to claim 1 in a hole cup.

8. Use of a hole cup according to claim 1 together with the ferrule.

9. An apparatus for a golf flag stick, comprising a cup and a ferrule, the cup comprising a cylindrical wall and a center hole having a size and a depth for receiving a lower part of the ferrule, the ferrule comprising a boring for receiving the golf flag stick, the ferrule having an upper part above the lower part, the upper part having a diameter greater than a diameter of the lower part and greater than a diameter of the center hole, at least two annular grooves positioned as far away from each other as possible in the lower part of the ferrule, at each end of the lower part of the ferrule, at least two removable elastic means in the at least two annular grooves, and at least one longitudinal groove in the ferrule.

10. The apparatus of claim 9, wherein each fastener is annular for being retained in the annular grooves.

11. The apparatus of claim 10, wherein the elastic means has a polygonal cross-section.

12. The apparatus of claim 11, wherein the elastic means is an elastic band.

13. The apparatus of claim 10, wherein the elastic means has a round cross-section.

14. The apparatus of claim 13, wherein the elastic means is an O-ring.

15. The apparatus of claim 9, wherein the lower part of the ferrule has a cylindrical shape.

16. The apparatus of claim 9, wherein the at least two annular grooves are respectively positioned near upper and lower ends of the ferrule.

17. The apparatus of claim 16, further comprising at least one additional annular groove disposed between the at least two annular grooves near the ends of the ferrule, and wherein at least one elastic means is mounted in the at least one additional annular groove.

18. The apparatus of claim 9, wherein the lower part of the ferrule has a length greater than a length of the center hole of the cup.

19. The apparatus of claim 9, wherein each annular groove has a profile for receiving a 4 mm O-ring, and each elastic means is a 4 mm O-ring.

20. Apparatus comprising a ferrule (1) for fitting in a hole cup for holding a flag stick (17) of a golf flag (3), where the ferrule (1) has a boring (4) in which a bottom end of the flag stick (17) of the golf flag (3) is placed, and wherein the ferrule has a relatively short upper part (5) and a relatively long lower part (6), the upper part (5) having a greater diameter than the lower part (6) of the ferrule, the lower part of the ferrule being configured for disposition in a center hole in the hole cup, the center hole having a shape and a depth for receiving the lower part (6) of the ferrule, wherein at least two replaceable elastic means (10) are provided as far away from each other at each end of the lower part (6) of the ferrule for holding the lower part of the ferrule in and spaced from the center hole of the hole cup, for maximum stability and certainty against overturning the flag and correspondingly at least two fastening means (11) are provided far away from each other in the lower part of the ferrule, each for retaining one of the elastic means (10), and each of the fastening means being provided by an annular groove (15) on the ferrule (1), and one or more longitudinal grooves (16) are provided in the ferrule (1) extending through the annular grooves for removing the elastic means from the annular grooves before replacing the elastic means, and wherein the elastic means separate the lower end of the ferrule from the center hole to provide greater resistance against wear and longer durability and maintain an ability to keep the flag stick upright even after being subjected to wind and weather and usual wear during use.

* * * * *